US007559668B1

(12) United States Patent
Aubrey

(10) Patent No.: US 7,559,668 B1
(45) Date of Patent: Jul. 14, 2009

(54) FLOATING MIRROR

(76) Inventor: Truman Aubrey, 1472 Beaudry Blvd., Glendale, CA (US) 91208

( * ) Notice: Subject to any disclaimer, the term of this patent is extended or adjusted under 35 U.S.C. 154(b) by 0 days.

(21) Appl. No.: 11/197,871

(22) Filed: Aug. 8, 2005

(51) Int. Cl.
*F21S 8/00* (2006.01)

(52) U.S. Cl. ..... 362/140; 362/260

(58) Field of Classification Search ..... 362/135–137, 362/140, 127–129, 132–133, 260, 285, 614, 362/633, 634, 233, 238, 217, 219; 248/466–467, 248/476, 477, 475.1, 480, 479, 473, 469, 248/488, 489, 468, 490, 497; 312/224–227; 40/219

See application file for complete search history.

(56) References Cited

U.S. PATENT DOCUMENTS 1,868,104 A * 7/1932 Hoegger ..... 359/854
1,930,244 A * 10/1933 Lewinsohn et al. ..... 362/129
2,313,838 A * 3/1943 Nordquist ..... 362/140
2,570,569 A * 10/1951 Leathorn ..... 362/140
2,609,485 A * 9/1952 Holley ..... 362/129
2,678,252 A * 5/1954 Swearingen ..... 312/223.5
2,791,675 A * 5/1957 Morrison ..... 362/128
2,876,056 A * 3/1959 Berger ..... 312/223.5
3,031,159 A * 4/1962 Waller ..... 52/544
3,038,771 A * 6/1962 Schwartz et al. ..... 312/223.5
3,104,830 A * 9/1963 Rock ..... 362/144
3,757,103 A * 9/1973 Walter ..... 362/2
4,479,172 A * 10/1984 Connor ..... 362/492
4,710,856 A * 12/1987 Cheung ..... 362/492
4,884,176 A * 11/1989 Palka et al. ..... 362/135
5,140,506 A * 8/1992 Katz ..... 362/135
5,398,906 A * 3/1995 Aydelott ..... 248/547
5,555,654 A * 9/1996 Hermann ..... 40/714
5,575,552 A * 11/1996 Faloon et al. ..... 362/492
5,671,097 A * 9/1997 Merriweather, Jr. ..... 359/871
2004/0196652 A1 * 10/2004 Jines et al. ..... 362/140

FOREIGN PATENT DOCUMENTS

GB 2256960 A * 12/1992
JP 06062938 A * 3/1994

* cited by examiner

*Primary Examiner*—Jong-Suk (James) Lee
*Assistant Examiner*—Julie A Shallenberger
(74) *Attorney, Agent, or Firm*—G. Donald Weber, Jr.

(57) ABSTRACT

An apparatus including a mirror mounted to a frame which attaches to a peripheral back lighting assembly that supports the mirror assembly.

21 Claims, 3 Drawing Sheets

FLOATING MIRROR

BACKGROUND

1. Field of the Invention

This invention is directed to an aesthetically pleasing back lighting assembly used with mirrors, in general, and to a back lighting assembly which, in its preferred embodiment, illuminates the entire peripheral dimension of a mirror which has translucent edges, in particular. A design that illuminates only two or three of the translucent edges is also envisioned.

2. Prior Art

There are many examples of illuminated mirrors in the product. Most of these mirrors are illuminated by separate lighting assemblies which are mounted above or to the side of the mirror. These known assemblies are largely acceptable and functional in most cases. However, these separate assemblies require additional wall space in the installation. Also, these assemblies have limitations as to the styles of light fixtures which can be used. Moreover, the installation of the requisite components poses problems in proper alignment.

In the past, attempts have been made to back light mirrors. These attempts have met with limited success. For example, the prior art units were less than acceptable in terms of the amount of light provided to the mirror. Moreover, the prior art units devices (and/or assemblies) had dark "corners" of the mirrors which resulted in the inadequate provision of light at the mirror surface as well as the aesthetically unpleasing appearance of the back lit mirror.

With fixtures using prior art, the point where a corner intersects to complete the geometry of the shape, an objectionable dark spot is present.

To eliminate this objectionable dark spot behind the translucent area of the outer perimeter of the mirror, circular fixtures have previously been introduced. Those fixtures use "circular fluorescent lamps," "circle-line" lamps have a single point of electrical connection. The fluorescent tube is formed into a round 360-degree figure. Nevertheless, even uniform illumination is not achieved behind the outer perimeter of the translucent portion of the mirror because of a dark spot where the socket termination occurs.

SUMMARY OF THE INSTANT INVENTION

This invention is a back lit mirror apparatus. The mirror comprises a piece of silvered glass (or a typical mirror) with at least a portion of the perimeter thereof treated to remove the silver backing. Typically, the effected portion of the perimeter of the mirror is rendered translucent to reduce glare and to produce an attractive appearance. A frame for supporting the glass (mirror) also supports light sources (typically fluorescent bulbs or tubes) which are mounted so as to overlap each other at the corners of the frame in order to provide a fully illuminated perimeter of the treated mirror glass.

The invention uses standard linear fluorescent lamps that are in common usage and are readily available. Thus, the length of the conventional light source can dictate the physical dimension of a square or rectangular fixture. Other shapes with linear, three, six or other multi-sided configurations are contemplated.

DESCRIPTION OF A PREFERRED EMBODIMENT

Figure 1:
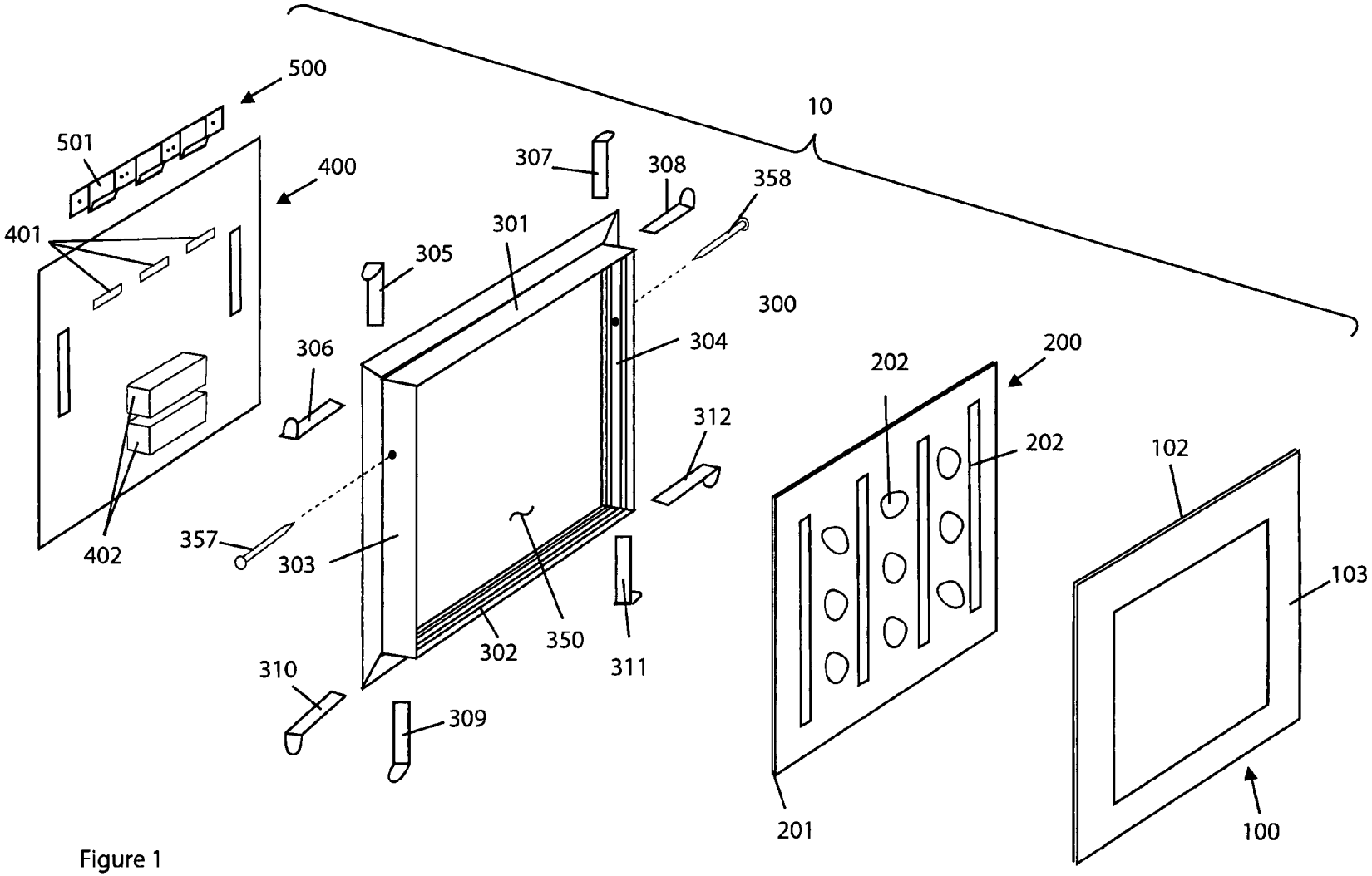
FIG. 1 is an exploded view of one embodiment of the floating mirror apparatus of the instant invention showing the general arrangement of the significant components of the application.

Referring now to FIG. 1, there is shown an exploded view of the floating mirror assembly 10 of the instant invention. The assembly 10 comprises a mirror 100, a mirror support sheet 200, a support frame 300, a mounting plate 400 with a plurality of fluorescent tube brackets (or socket supports) 305-312 and a support rack 500. Fluorescent tubes to be mounted in the brackets and specific details of some of the components are omitted in this view.

The mirror 100 is, typically, made of a sheet of glass 102 with a silvered backing. Any conventional mirror can be utilized. A peripheral border 103 is formed around the outer edge of the glass by removing (or initially omitting) the silver backing for a prescribed distance from the edge of the mirror. In typical applications, the border is about 3" wide although this dimension is not limitative of the invention and is subject to aesthetic tastes.

The border 103 is, preferably, rendered translucent by sandblasting (or the like) during removal of the silver backing. Alternatively, the back of the glass can be acid etched or the like. Other methods of rendering the glass translucent are contemplated.

Figure 2:
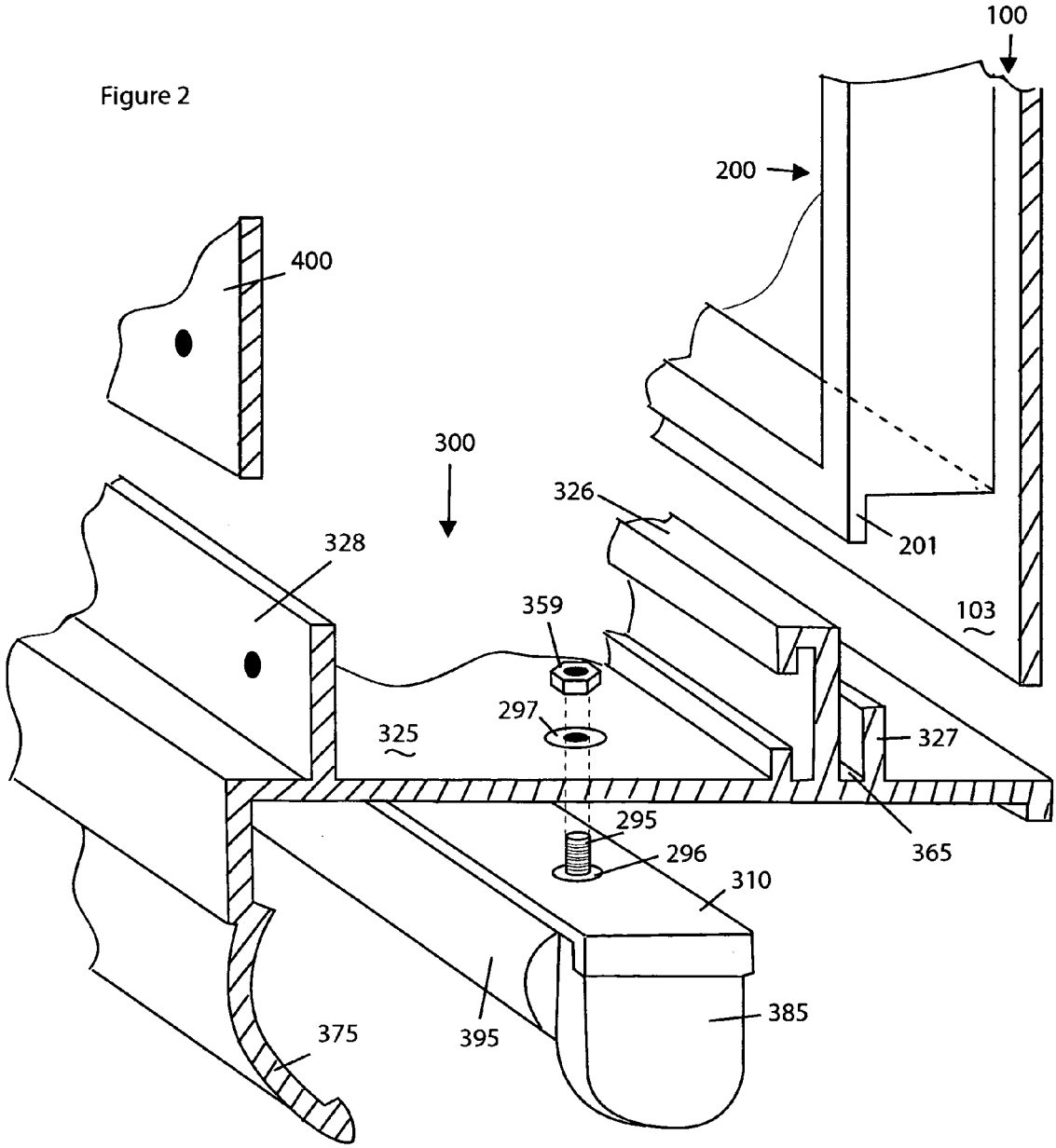
FIG. 2 is a partially broken away, detailed sectional view of the bottom of the support frame for the floating mirror apparatus of the instant invention.

Mirror support sheet 200 is a sheet of metal or other suitable material of sufficient strength to support mirror 100 thereon. As best seen in FIG. 2, the edges of the support (or backing) sheet 200 are bent or otherwise formed to provide a strengthening edge to the sheet. In addition, the formed edges include an appropriate lip 201 (see FIG. 2) to interlock with ridges formed in the support frame 300 as described infra.

In a preferred embodiment, the mirror 100 is attached to sheet 200 by a suitable adhesive which is represented by layer 202 on the surface of sheet 200. The adhesive 202 can be applied in strips or any other suitable configuration.

The support frame 300 is, typically, fabricated of metal such as, but not limited to, aluminum or the like. In a preferred embodiment, as shown in FIG. 1, the support frame 300 includes horizontal brackets 301 and 302 as well as vertical brackets 303 and 304. A detailed showing of the structure of the bottom bracket is provided in FIG. 2. The horizontal and vertical brackets are joined together at the ends thereof to form the support frame 300 which is adapted to be attached to mounting plate 400. In a preferred embodiment, the brackets (or support frame sides) exhibit a reflective finish such as glossy white paint or the like as described infra.

The brackets 301-304 include a reflective shield 375 which extends outwardly therefrom (see FIG. 2). In a preferred embodiment, each of the reflective shields has an arcuate configuration to impart a convex outer configuration to the support frame.

Socket supports 305-312 are individually mounted at the ends of the horizontal and vertical brackets 301 through 304. In particular, each of the individual socket supports (for example socket support 305) extends outwardly beyond the end of the respective bracket (for example, bracket 303). Thus, the respective socket supports on intersecting brackets extend outwardly from the ends of brackets and, effectively, cross each other. However, the socket supports do not extend (and are not visible) beyond the edges of the mirror 100.

Thus, the light sources which are mounted in the light sockets (see FIG. 3) are positioned behind the translucent border 103 portion of the mirror 101 essentially from edge-to-edge.

Mounting plate 400 is, typically, a sheet of metal or other suitable material of sufficient strength to support the apparatus 10. The mounting plate 400 is attached to the support frame 300, for example by welding or any other suitable means.

In the preferred embodiment, the plate 400 includes at least one aperture 401 therethrough for mounting directly to a wall or to a suitable support structure such as mounting bracket 500 described infra. However, any suitable mounting technique and apparatus can be utilized.

A suitable support rack 500 can be mounted to the supporting wall by screws, toggle bolts, molly bolts or the like. In this embodiment, the support rack includes three mounting hooks 501. The mounting plate 400 includes three apertures 401 which engage the hooks 501 wherein the apparatus 10 is adapted to be attached to the support rack 500, if desired.

In a typical arrangement, the electrical connections, ballasts and the like (represented by components 402) can be mounted on plate 400 within the receptacle space 350 formed by the assembled brackets which form frame 300.

Referring now to FIG. 2, there is shown a partially broken away, partial cross-sectional view of the floating mirror assembly 10. As noted supra, the support frame 300 is an assembly formed by joining together the ends of side brackets 301-304 (in this rectilinear embodiment) and the mounting plate 400. The receptacle space 350 (see FIG. 1) is, typically, rectilinear as defined by the frame 300.

At least one of the frame brackets, e.g., bracket 302 which forms the bottom of the frame 300, includes a plurality of ledges substantially perpendicular to a main planar body 325. Ledges 326 and 327 are substantially parallel to each other and form a groove 365 therebetween along the length of the frame 300. The groove 365 is adapted to receive the lower lip 201 of the mirror support sheet 200 (to which the mirror 100 is attached). After the lower lip 201 of the mirror support sheet 200 is inserted into the elongated groove 365, the mirror support sheet assembly is then placed in position within the fixture frame 300 and retained in position by screws or other suitable fasteners which are applied at or through holes in the fixture frame 300, typically towards the top of the frame sections 303 and 304, as suggested by the screws 357 and 358 shown in FIG. 1.

As seen in FIG. 2, ledge 328 extends substantially perpendicular to the inner surface 325 of frame section 302 and parallel to ledges 326 and 327. Ledge 328 is provided to receive and support mounting plate 400. The plate 400 can be attached to ledge 328 by screws, nuts and bolts, spot welding or the like, as suggested by the mounting holes.

Figure 3:
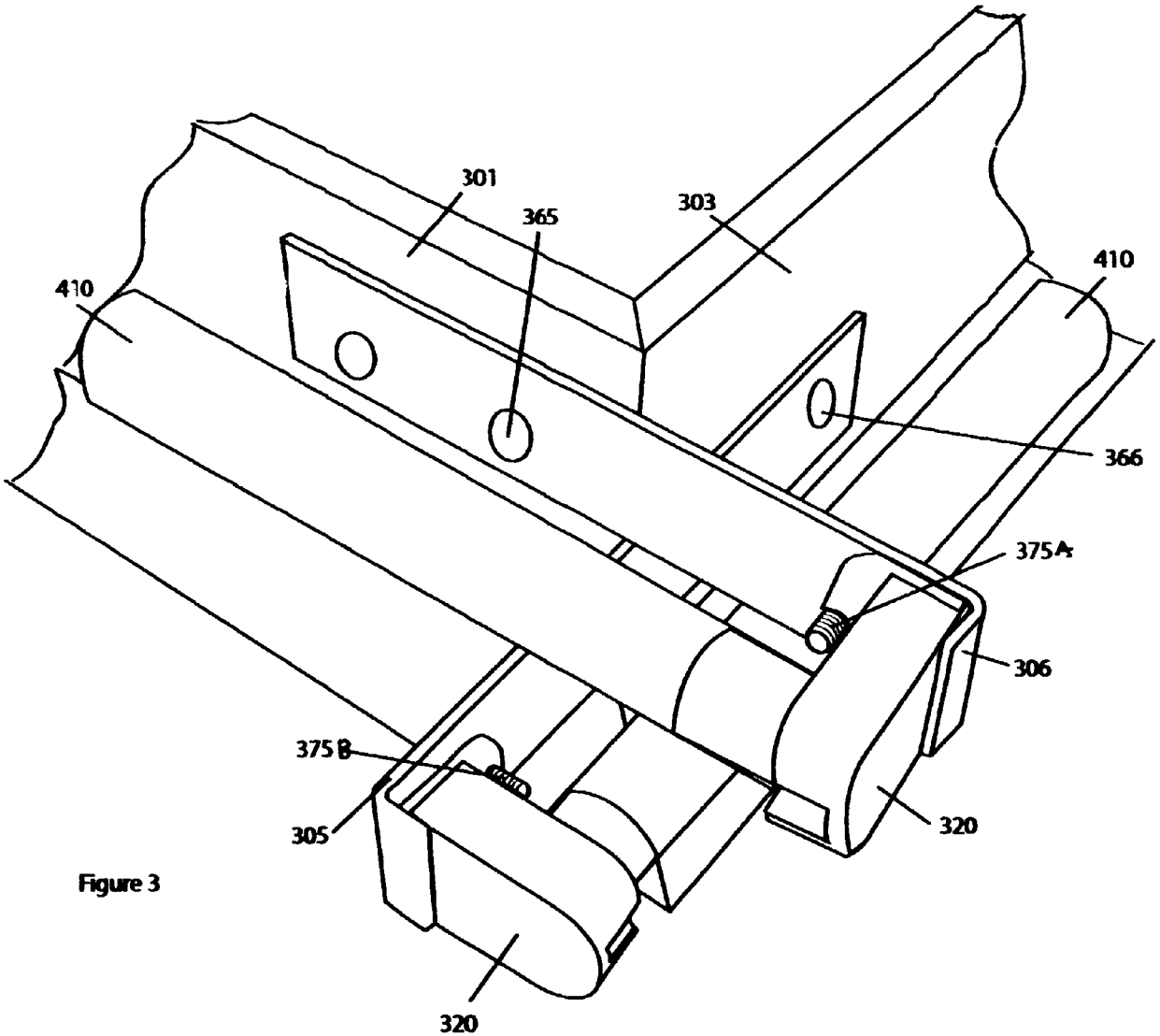
FIG. 3 is a detailed view of the overlapping end construction of the support frame and the overlapping ends of the light sources of the floating mirror of the instant invention

Frame brackets 301-304 include an outer edge reflector surface 375 which is attached to or formed with the planar surface 325 to form a single frame bracket. As described supra, the surface 375 is, preferably, curved to provide the convex outer surface for frame 300. In the finished assembly, the ends of brackets 301-304 are cut at an angle to provide an aesthetically pleasing mitered corner as seen in FIGS. 1 and 3.

A representative socket support 310 is shown adjacent to the under surface of bracket 302 to indicate the location thereof in the assembled unit 10. The socket support 310 can be affixed to the bracket 302 by screws 295 which pass through properly sized holes 296 and 297 through the support 310 and the bracket 302 and secured with a nut 359, a self tapping screw or the like. Alternatively, these components can be spot welded together or attached in any other appropriate fashion.

A light source socket 385 is attached to the socket support by separate screws, bolts or in any appropriate fashion or by screw 295. The socket 385 is conventional in the art.

A light source 395, typically a fluorescent tube, is inserted into the socket 385 when the unit 10 is assembled. Light from source 395 passes through the translucent portion of mirror 100. In addition, the reflective shield 375 reflects light from source 395 back through the translucent peripheral portion 103 of mirror 100 which extends beyond the bracket 302 and over the light source 395 (including the respective mounting devices). Thus, a perimeter light ring appears around the mirror 100.

Referring now to FIG. 3, there is shown an enlarged view of the ends of the horizontal and vertical brackets 301 and 303 of the support frame 300 (see FIG. 2) with the socket supports 306 and 305 mounted thereon, respectively.

The socket supports 305-306 (representative of supports 305-312 in FIG. 1) are, typically, angle brackets formed of a sufficiently strong material such as aluminum or the like. These angle brackets, like the frame members, are preferably finished with a highly reflective material such as an anodized surface or the like in order to reflect light from the light source.

The socket supports 305-312 each include one or more apertures thereon to permit attachment to the respective horizontal or vertical bracket by screws, or the like. Of course, the various components may be welded or riveted together as shown by rivets 365 and 366 in FIG. 3 or may all be fabricated as a unitary member.

A conventional socket 320 of appropriate design is mounted on each socket support 305-312, typically, by screws, rivets or nuts and bolts 375A and 375B to receive the light source which is, typically, a conventional fluorescent lamp 410.

The light sources 410 are seen to overlap each other at the respective ends thereof. These ends extend beyond the respective brackets 301-304 and the respective corners which form the frame 300. Thus, referring to FIG. 2, the ends of the several (typically four) fluorescent tubes extend beyond the four corners of the frame 300. These overlapped light sources are positioned behind the translucent perimeter of the mirror but not beyond the edges of the sides of the glass of mirror 100. This arrangement provides a continuous light pattern around the entire perimeter of the mirror without dark corners and without excessive glare from the light sources.

Thus, there is shown and described a unique design and concept of a floating mirror. While this description is directed to particular embodiments, it is understood that those skilled in the art may conceive modifications and/or variations to the specific embodiments shown and described herein. Any such modifications or variations which within the purview of this description are intended to be included therein as well. It is understood that the description herein is intended to be illustrative only and is not intended to be limitative. Rather, the scope of the invention described herein is limited only by the claims appended hereto.

The invention claimed is:

1. A lighted mirror assembly comprising, a frame, a plurality of light sources, a plurality of sockets for receiving said light sources, a plurality of socket supports for respectively supporting said sockets in different planes, each of said socket supports mounted to said frame with at least one end thereof extending outwardly from said frame in different planes, each of said sockets respectively attached to said one end of said socket supports such that said sockets are located in different planes beyond said frame such that the ends of said light sources supported in said sockets overlap each in different planes other beyond said frame, and a mirror mounted to and extending outwardly from the periphery of said frame, at least a portion of the periphery of said mirror is translucent and extends beyond said frame and overlies said light sources and the overlapped ends thereof.

2. The assembly recited in claim 1 including, a mounting means mounted to said frame in order to support the assembly.

3. The assembly recited in claim 2 including, electrical components mounted to said mounting means to control the operation of said light sources.

4. The assembly recited in claim 1 wherein, said frame includes support means for supporting said mirror thereon.

5. The assembly recited in claim 4 including, a support sheet attached a rear surface of said mirror for mounting said support means of said mirror to said frame.

6. The assembly recited in claim 1 wherein, said frame comprises a plurality of side members which are joined together at the ends thereof.

7. The assembly recited in claim 2 including, a support rack engaging said mounting means for selectively mounting said assembly to a support structure.

8. The assembly recited in claim 1 wherein, said light sources comprise fluorescent light tubes.

9. The assembly recited in claim 1 including, reflective shields extending outwardly from said frame to reflect light from said light sources through said portion of said mirror which is translucent.

10. The assembly recited in claim 9 wherein, said reflective shields are arcuate in configuration.

11. The assembly recited in claim 9 wherein, said frame and said reflective shields are fabricated with a reflective material.

12. The assembly recited in claim 5 including, adhesive means for attaching said mirror to said support sheet.

13. The assembly recited in claim 5 wherein, said support means of said frame includes a plurality of substantially parallel ledges on a surface thereof which ledges form at least one groove therebetween, said grove is adapted to receive a portion of said support means.

14. A back lit mirror assembly comprising, a mirror comprising a piece of silvered glass with a peripheral border portion thereof which has been treated to render the peripheral border portion translucent, a frame for supporting said mirror, a plurality of light source support means mounted to and extending beyond the perimeter of said frame in a spaced apart planes, and a plurality of elongated light sources which are mounted respectively to said light source support means so as to extend beyond the perimeter of said frame in different planes thereby to overlap each other beyond corners of said frame and behind the peripheral border portion of said mirror in order to provide a fully illuminated perimeter of said mirror.

15. The assembly recited in claim 14 including, socket supports attached to said frame to support sockets for said light sources.

16. The assembly recited in claim 14 wherein, said light sources comprise linear fluorescent lamps.

17. The assembly recited in claim 14 wherein, said frame includes at least one groove therein for receiving and securing said mirror to said frame.

18. The assembly recited in claim 14 including, a support rack adapted for mounting to a separate support structure to receive and support the frame of the assembly.

19. A mirror assembly with full peripheral back-lighting comprising, a frame, a plurality of socket support means mounted to said frame in spaced apart relationship with portions thereof extending outwardly from said frame in different planes, sockets for mounting light sources, each of said sockets respectively attached to said portions of said socket support means such that light sources mounted in said sockets extend outwardly from the frame such that ends of adjacent light sources overlap each other in different planes, a mirror mounted to said frame and extending outwardly from the periphery thereof, a support sheet attached to said mirror for supporting said mirror, said frame includes a plurality of substantially parallel ledges which form at least one groove therebetween to receive a portion of said support sheet and said mirror, a translucent band included at the entire periphery of said mirror, a support rack adapted to be mounted on an external support structure for mounting said assembly to the support structure, and reflective shields extending outwardly from said frame and mounted to reflect light from light sources mounted in said sockets through said translucent band at the periphery of said mirror.

20. A back lit mirror assembly comprising, a mirror comprising a sheet of silvered glass, a peripheral band of said mirror which is translucent, a support sheet attached to the rear surface of said mirror, a frame comprising a plurality of side members which are joined together at ends thereof, a plurality of socket supports mounted to and extending outwardly from each of the side members of said frame adjacent the ends of the side members such that the outer ends of said socket supports on adjacent side members overlie each other, a plurality of light sockets respectively attached to said outer ends of said socket supports such that said light sockets extend beyond the side members of said frame and overlie each other in different planes, said mirror mounted to and extending outwardly from the periphery of said frame, a plurality of elongated light sources, said light sources are mounted in said light sockets such that ends of adjacent said light sources overlap each other in different planes at external corners of said frame behind said peripheral band of said mirror in order to provide a fully illuminated perimeter of said mirror, support means on one of said side members of said frame for supporting said mirror and said support sheet thereon, a support rack adapted to be mounted on a separate support structure for mounting said assembly to the support structure, and reflective shields extending outwardly from said frame and mounted to reflect light through said peripheral band portion of said mirror which is translucent.

21. The assembly recited in claim 20 wherein, a plurality of substantially parallel ledges at one of the sides of said frame which ledges form at lest one groove therebetween to receive a portion of said support sheet and said mirror.

* * * * *